US007717362B2

(12) United States Patent
Beh et al.

(10) Patent No.: US 7,717,362 B2
(45) Date of Patent: May 18, 2010

(54) PULL-DOWN SPRAY HEAD WITH METAL SHELL

(75) Inventors: Thomas Beh, Corona Del Mar, CA (US); Vinh Vu, Lawndale, CA (US)

(73) Assignee: Brasstech, Inc., Santa Ana, CA (US)

( * ) Notice: Subject to any disclaimer, the term of this patent is extended or adjusted under 35 U.S.C. 154(b) by 714 days.

(21) Appl. No.: 11/368,543

(22) Filed: Mar. 6, 2006

(65) Prior Publication Data

US 2007/0235570 A1 Oct. 11, 2007

(51) Int. Cl.
*B05B 1/00* (2006.01)

(52) U.S. Cl. ..... 239/600; 239/525; 239/530; 285/258; 285/282; 285/316

(58) Field of Classification Search ..... 239/447, 239/525–532, 600; 285/242, 282, 316
See application file for complete search history.

(56) References Cited

U.S. PATENT DOCUMENTS 1,561,275 A * 11/1925 Page ..... 239/558
4,700,890 A 10/1987 Hasegawa
5,090,624 A 2/1992 Rogers
5,127,580 A 7/1992 Fu-I
5,277,454 A 1/1994 Lorch et al.
5,558,278 A 9/1996 Gallorini
5,829,469 A * 11/1998 Sileno et al. ..... 137/15.08
6,173,910 B1 1/2001 Yean
6,220,297 B1 * 4/2001 Marty et al. ..... 137/801
6,270,023 B1 8/2001 Farley
6,370,713 B2 * 4/2002 Bosio ..... 4/677
6,446,278 B1 9/2002 Lin
6,619,567 B1 * 9/2003 Ouyoung ..... 239/441
6,880,768 B2 4/2005 Lau
7,077,342 B2 * 7/2006 Lee ..... 239/589
2004/0237188 A1 * 12/2004 Marcellus ..... 4/625

* cited by examiner

*Primary Examiner*—Dinh Q Nguyen
(74) *Attorney, Agent, or Firm*—Carlson, Gaskey & Olds PC

(57) ABSTRACT

An spray head includes a spray engine and a metal shell retained on the spray engine. The spray head is assembled by fitting the shell onto the spray engine and seating the shell against a cushioning ring. A retaining device is attached to the spray engine to secure the shell is position. A surface finish is applied to the outer surface of the shell to achieve a desired appearance.

3 Claims, 2 Drawing Sheets

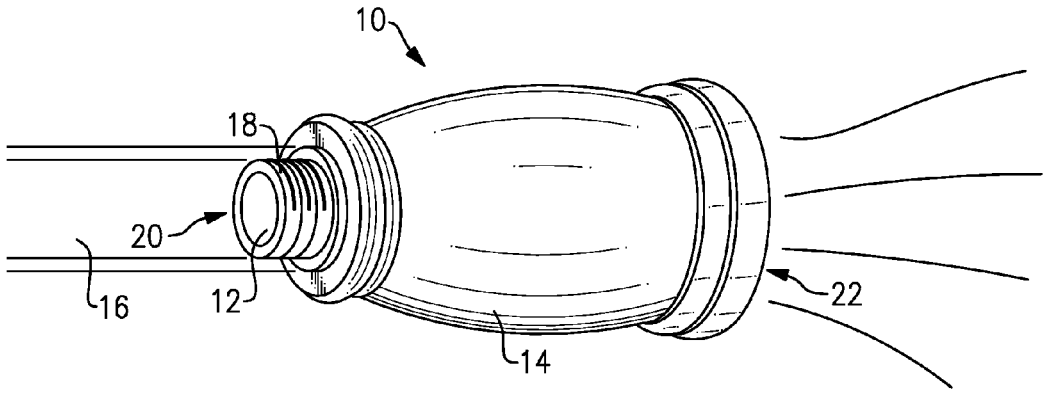
FIG.1
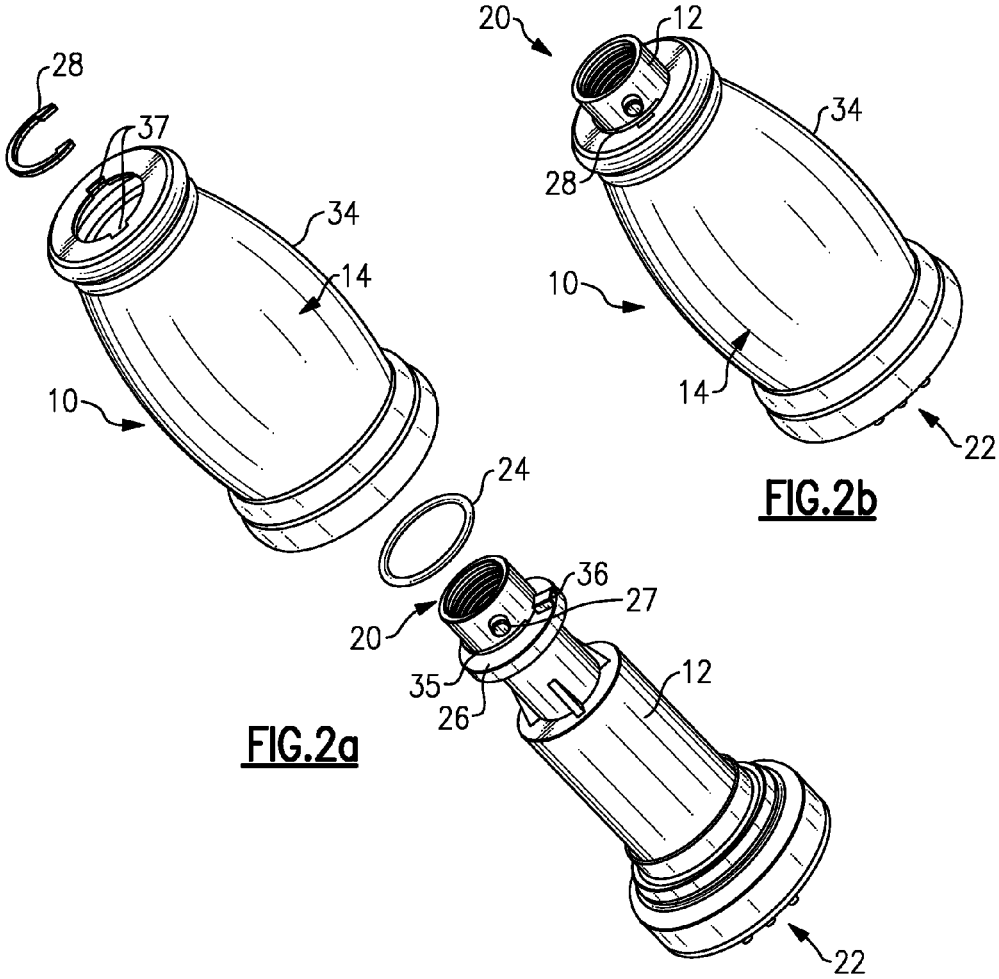
FIG.2a
FIG.2b

PULL-DOWN SPRAY HEAD WITH METAL SHELL

BACKGROUND OF THE INVENTION

This invention relates to a spray head having a spray engine and a metal shell retained on the spray engine.

Spray heads for use in homes commonly have hand-held or extending portions allowing the user to manipulate the direction of water spray as desired. Recently, spray heads have been manufactured in separate pieces including a spray engine and a spray cover designed to be placed over the spray engine. The spray covers are formed to include the necessary retaining elements to secure the spray cover to the spray engine.

By separately providing the components of the spray head the user can select among different spray covers providing a desired look. The spray covers are plastic to provide an inexpensive and lightweight device that can be easily manipulated by the user. However, adding surface finishes after forming the spray covers is difficult because many plating materials are not compatible with a plastic base.

However, forming a metal spray cover that includes the necessary retaining elements requires that the spray cover be formed using a casting or forging process. Spray covers manufactured from a casting or forging process result in a heavy difficult to use cover.

It is therefore desirable to provide a spray head having a metal shell which is light weight and simply retained to a spray engine.

SUMMARY OF THE INVENTION

An example spray head according to this invention includes a spray engine and a metal shell retained on the spray engine.

The spray head is assembled by fitting the shell onto the spray engine and seating the shell against a cushioning ring. A retaining clip or threaded nut secures the shell in position. The cushioning ring between the spray engine and the shell eliminates slack and prevents the shell from rattling once assembled.

The shell is manufactured using a hydroform process, that provides the desired lightweight product. A surface finish is applied to the outer surface of the shell to provide a desired appearance. The shell is a separate piece that is finished separately from other components of the spray head.

These and other features of the present invention can be best understood from the following specification and drawings, the following of which is a brief description.

BRIEF DESCRIPTION OF THE DRAWINGS

FIG. 1 is a perspective view of an example spray head of the present invention having a spray engine and a shell;

FIG. 2*a* is an exploded view of an example spray head of the present invention;

FIG. 2*b* is an assembled view of an example spray head of the present invention;

DETAILED DESCRIPTION OF THE PREFERRED EMBODIMENT

Figure 3A:
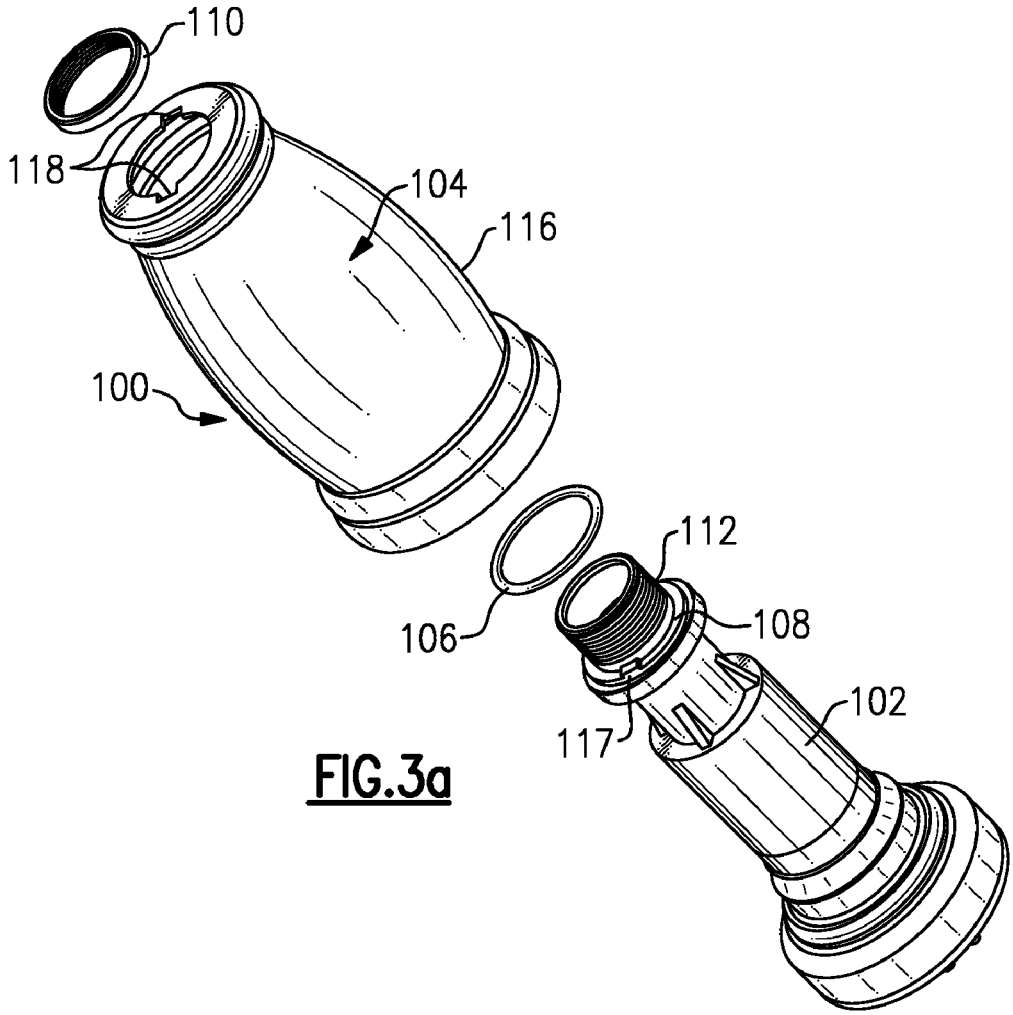
FIG. 3*a* is an exploded view of another example spray head of the present invention.

FIG. 1 illustrates a spray head 10 having a spray engine 12 and a shell 14. The spray head 10 is connected to a water supply pipe 16 through the spray engine 12. The spray engine 12 has a threaded portion 18 located proximate to a first end 20 for securing the spray head 10 to the water supply tube 16. Water exits through a second end 22 of the spray engine 12, as illustrated. The shell 14 surrounds a portion of the spray engine 12. The spray engine 12 is self-contained and includes the first end 20 and the second end 22 that are accessible through opposing ends of the shell 14. Water enters the first end 20, passes through the interior of the spray engine 12, and exits the second end 22. Therefore providing a waterproof seal between the shell 14 and the spray engine 12 is not required.

Referring to FIGS. 2*a* and 2*b*, a cushioning ring 24 is placed on the spray engine 12 and is seated against a surface 26. The shell 14 is then assembled onto the spray engine 12 by slipping the pins 27 of the engine 12 through the slots 37 and seated against the cushioning ring 24. An inside surface of the shell 14 contacts the cushioning ring 24. A retaining clip 28 engages the spray engine 12 to secure the shell 14 in position. The retaining clip 28 is a snap ring, but may be any type of clip able to retain the shell 14 to the spray engine 12. The retaining clip 28 surrounds a majority of the circumference of the groove 35 proximate to the first end 20 of the spray engine 12. Once the retaining clip 28 is placed into the groove 35 around the diameter of the first end 20 force must be applied to spread ends of the retaining clip 28 apart in order to remove the retaining clip 28 from the spray engine 12, thereby holding the retaining clip 28 to its proximate location and preventing the retaining clip 28 from separating from the spray engine 12 during normal operation. Additionally, the cut-out slots 37 of the metal shell 14 engage with the protrusion tabs 36 of the spray engine 12 to prevent rotation of the shell 14 with respect to the spray engine 12. The cushioning ring 24 is disposed between the surface 26 and the shell 14 to bias the shell 14 against the retaining clip 28. The bias pressure provided by the cushioning ring 24 substantially eliminates slack between the retaining clip 28 and the shell 14 to prevent relative movement and rattling between the shell 14 and the spray head 10.

The shell 14 is manufactured using a hydroform process. Using a hydroform process provides a shell that is thinner than is possible either by a casting or forging process. The thinner shell 14 provides a desirable light weight spray head 10. Additionally, using metal to form the shell 14 provides a shell having a solid feel that is pleasing to a user and of a lighter weight. The shell 14 is preferably brass, but may be any type of metal. The shell 14 includes an outer surface 34 to which a surface finish is applied. The surface finish provides a desired appearance for the spray head 10. For example, a powder coating may be applied to achieve a particular color of the shell 14. The metal shell 14 may also be plated with different metal finishes, such as chrome. Because the shell 14 is a separate piece, the spray engine 12 need not be part of the finishing process. Separate finishing of the shell 14 from the spray engine 12 prevents potential damage to the spray engine 12 during the finishing process. For example, heating required in a powder coating process is not compatible with the pray engine 12.

Figure 3B:
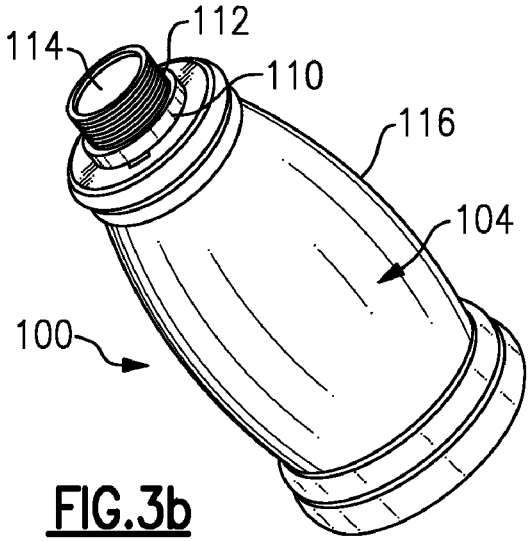
FIG. 3*b* is an assembled view of another example spray head of the present invention.

Referring to FIGS. 3*a* and 3*b*, another example the spray head 100 includes a spray engine 102 and a shell 104. A cushioning ring 106 is placed on the spray engine 102 and is seated against a surface 108. The shell 104 is assembled onto the spray engine 102 and seated against the cushioning ring 106. A threaded nut 110 is threaded onto a threaded portion 112 of the spray engine 102 to secure the shell 104 in position. The threaded portion 112 extends from the spray engine 102 proximate to a first end 114 for receiving the threaded nut 110. The threaded portion 112 extends a length past the threaded nut 110 when assembled. The length extending past the threaded nut 110 is used to attach the spray head 100 to the water supply tube 16.

The cushioning ring 106 biases the shell 104 against the threaded nut 110. The bias pressure prevents the threaded nut 110 from unscrewing from the spray engine 102. Additionally, the cut-out slots 118 of the metal shell 116 engage with the protrusion tab 117 of the spray engine 102 to prevent rotation of the shell 104 with respect to the spray engine 102. The shell 104 is metal, preferably brass, and manufactured using a hydroform process. The shell 104 has an outer surface 116 to which surface finishes are applied to achieve a desired appearance.

The example spray heads 10 and 100 may be used for any type of faucets where it is desirable to provide a spray head with a variety of finish appearances. Although a retaining clip 28 and a threaded nut 110 are described other methods of removably securing the shells 14 and 104 to the spray engines 12 and 102 may be used. The spray engines 12 and 102 are self-contained and include components contained within a housing operable independent of the shells 14 and 104.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A spray head for a faucet assembly comprising:

a spray engine having a stem for connection to a fluid supply tube, a locating tab, and a groove extending around a diameter of the spray engine;

a shell disposed around at least a portion of the spray engine, said stem extending through said shell and said shell having an opening for cooperating with said locating tab on said spray engine thereby preventing said shell from rotating about said spray engine; and a retaining clip for removably securing the metal shell to the spray engine, wherein said retaining clip engages said spray engine within said groove.

2. The spray head of claim 1 wherein said spray engine further comprises a pin that extends through said opening in said shell if said shell is attached to said engine.

3. The spray head of claim 2 wherein said pin is offset from said locating tab such that if said tab is in said opening said pin is offset from said opening.

* * * * *